US006626735B2

(12) United States Patent
Ammi

(10) Patent No.: US 6,626,735 B2
(45) Date of Patent: Sep. 30, 2003

(54) METHOD OF STOPPING MACHINING OPERATION IN MACHINE TOOL AND MACHINING CONTROLLING APPARATUS FOR IMPLEMENTING THE SAME

(75) Inventor: Sadatsune Ammi, Toyama (JP)

(73) Assignee: Nippei Toyama Corporation, Tokyo (JP)

( * ) Notice: Subject to any disclaimer, the term of this patent is extended or adjusted under 35 U.S.C. 154(b) by 0 days.

(21) Appl. No.: 09/963,422

(22) Filed: Sep. 27, 2001

(65) Prior Publication Data

US 2002/0039873 A1 Apr. 4, 2002

(30) Foreign Application Priority Data

Oct. 3, 2000 (JP) ..... P2000-303878

(51) Int. Cl.[7] ..... B24B 5/42

(52) U.S. Cl. ..... 451/5; 451/8; 451/49; 451/242

(58) Field of Search ..... 451/5, 8, 49, 9, 451/59, 242, 246, 249; 51/165.88, 165.77

(56) References Cited

U.S. PATENT DOCUMENTS 4,484,413 A * 11/1984 Yamamoto et al. ..... 451/5
4,490,946 A * 1/1985 Tsujiuchi et al. ..... 451/5
4,584,796 A * 4/1986 Yoneda et al. ..... 451/5
4,678,980 A * 7/1987 Sugimoto et al. ..... 318/759
4,773,187 A * 9/1988 Ohta et al. ..... 451/5
5,453,037 A * 9/1995 Lehmann ..... 451/5
5,562,526 A * 10/1996 Yoneda et al. ..... 451/9
5,766,059 A * 6/1998 Imai et al. ..... 451/49
5,777,450 A * 7/1998 Kono et al. ..... 318/568.11
6,419,563 B1 * 7/2002 Ido et al. ..... 451/57

FOREIGN PATENT DOCUMENTS

| | | |
|---|---|---|
| JP | 5-77148 | 3/1993 |
| JP | 5-177491 | 7/1993 |
| JP | 8-54914 | 2/1996 |
| JP | 8-227307 | 9/1996 |
| JP | 8-290342 | 11/1996 |
| JP | 11-77484 | 3/1999 |

* cited by examiner

*Primary Examiner*—George Nguyen
*Assistant Examiner*—Anthony Ojini
(74) *Attorney, Agent, or Firm*—Sughrue Mion, PLLC

(57) ABSTRACT

A machining controlling apparatus numerically controls a wheel spindle stock and a spindle apparatus, and performs the machining operation of a workpiece by a grinding wheel. When a power failure has been detected by a power-failure detecting unit, a grinding machine is stopped after the grinding wheel is retreated from the workpiece within a very short period until the controlling operation by the machining controlling apparatus becomes impossible.

12 Claims, 5 Drawing Sheets

METHOD OF STOPPING MACHINING OPERATION IN MACHINE TOOL AND MACHINING CONTROLLING APPARATUS FOR IMPLEMENTING THE SAME

BACKGROUND OF THE INVENTION

1. Field of the Invention

The present invention relates to a method of stopping machining operation in a grinding machine or the like and a machining controlling apparatus therefor.

2. Description of the Related Art

Recently, a grinding machine has a control system including a numerical control unit, and performs numerical control for high-precision machining of a workpiece. Specifically, the workpiece is ground by a grinding wheel while relatively moving the rotating grinding wheel with respect to the workpiece along a numerically controlled locus. However, in a conventional grinding machine having the numerical control unit, when a pin portion or the like of, for example, a camshaft or a crankshaft is ground while a journal thereof serves as a rotating shaft, such grinding requires to forwardly or backwardly move a wheel spindle stock with respect to the workpiece. For this reason, when a power failure has occurred, unless the timing when a spindle apparatus for rotatively driving the workpiece is stopped and the timing when the wheel spindle stock for forwardly or backwardly moving the grinding wheel is stopped coincide with each other, there is the possibility that the grinding wheel bumps into the workpiece, thereby causing damage to the workpiece or the machine. Therefore, such a grinding machine stops through a simple dynamic brake circuit interlocking with cutoff of power supply by means of a relay, or provides an uninterruptive power supply unit as a countermeasure against a power failure. At the time of a power failure, a dynamic brake is applied to a motor for rotatively driving the spindle apparatus by the numerical control unit whose power supply is backed up by the uninterruptive power supply unit, while mechanical driving portions other than the motor for rotatively driving the spindle apparatus are rapidly stopped by the use of regenerative resistance or mechanical brakes.

However, the uninterruptive power supply unit not only is expensive but also makes the equipment large.

SUMMARY OF THE INVENTION

Accordingly, the object of the invention is to provide a method of stopping machining operation in an apparatus having a tool for performing machining with respect to a workpiece in contact therewith, such as a grinding machine, for retreating the tool from the workpiece at the time of power failure without causing damage to the machine and the workpiece and without requiring an uninterruptive power supply unit which requires a large equipment in a controller, as well as a machining controlling apparatus.

To attain the above object, according to a first aspect of the invention, there is provided a method of stopping a machining operation of a machining tool, wherein the machining operation of the machine tool performed by synchronously driving a rotating workpiece held by a spindle apparatus and a reciprocating tool is controlled in accordance with machining profile data stored in a controlling apparatus, the method comprising the steps of:

preparing, in the controlling apparatus, a power-supply-drop detecting unit detecting a power failure or a drop in power supply supplied to the control unit and a tool-retreating-formula storing unit storing data based on a tool retreating formula for retreating the tool from the workpiece;

decelerating the spindle apparatus and adding the data based on the tool retreating formula into the machining profile data, when the power failure or the drop in power supply is detected; and retreating the tool from the workpiece in synchronous with the rotation of the spindle apparatus based on the added machining profile data within a period until the controlling operation by the controlling apparatus becomes impossible, whereby the machining tool is stopped after retreating the tool from the workpiece.

By adopting the above-described method of stopping the machining operation, when the power failure or the drop in power supply has been detected by the power-supply-drop detecting unit, the data based on the tool retreating formula is added to the machining profile data, and the tool is retreated from the workpiece within a period until the controlling operation by the controlling apparatus becomes impossible due to the drop in power supply, and the machine tool is subsequently stopped. Accordingly, even if a power failure has occurred, it is possible to prevent causing damage to the workpiece or the machine tool. For this reason, an uninterruptive power supply unit which has hitherto been required becomes unnecessary.

Further, according to a second aspect of the invention, there is provided a method of stopping a machining operation of a machining tool, wherein the machining operation of the machine tool performed by synchronously driving a rotating workpiece held by a spindle apparatus and a reciprocating tool is controlled in accordance with machining profile data stored in a controlling apparatus, the method comprising the steps of:

preparing, in the controlling apparatus, an input unit inputting an apparatus stop instruction for stopping the machining operation and a tool-retreating-formula storing unit storing data based on a tool retreating formula for retreating the tool from the workpiece;

decelerating the spindle apparatus and adding the data based on the tool retreating formula into the machining profile data, when the apparatus stop instruction is inputted; and retreating the tool from the workpiece in synchronous with the rotation of the spindle apparatus based on the added machining profile data within a period of time until the controlling operation by the controlling apparatus becomes impossible, whereby the machining tool is stopped after retreating the tool from the workpiece.

By adopting the above-described method of stopping the machining operation, when the apparatus stop instruction has been inputted, the control unit adds the data based on the tool retreating formula to the machining profile data, the tool is retreated from the workpiece within a predetermined period, and the machine tool subsequently stops. Accordingly, even if an instruction for such as an emergency stop or the like is inputted, the tool moves away from the workpiece smoothly and speedily and stops in such a manner as to be spaced apart from the workpiece, so that the machine tool can be stopped rapidly without causing damage to the workpiece or the machine tool.

In addition, according to a third aspect of the invention, in the method of the first and second aspects, the data based on the tool retreating formula to be added into the machining profile data is data for accelerating or decelerating a feeding speed of the tool with respect to the workpiece within a predetermined period.

By adopting the above-described method of stopping the machining operation, as the data based on the tool retreating formula is added to the machining profile data, when a power failure or a drop in power supply has been detected, or when the apparatus stop instruction has been inputted, the retreating speed of the tool gradually changes. As a result, a sudden speed change does not occur at the time of the disengagement of the tool engaged in machining, thereby making it possible to prevent causing damage to the apparatus.

Moreover, according to a fourth aspect of the invention, there is provided a machining controlling apparatus comprising:

a control unit controlling, in accordance with machining profile data, the machining operation of a machine tool performed by synchronously driving a rotating workpiece held in a spindle apparatus and a reciprocating tool;

a power-supply-drop detecting unit detecting a power failure or a drop in power supply supplied to the control unit; and a tool-retreating-formula storing unit storing data based on a tool retreating formula for retreating the tool from the workpiece, wherein when the power failure or the drop in power supply has been detected by the power-supply-drop detecting means, the control unit decelerates the spindle apparatus and adds the data based on the tool retreating formula to the machining profile data, and stops the machine tool after the tool is retreated from the workpiece in synchronous with the rotation of the spindle apparatus based on the added machining profile data within a period until the controlling operation by the control unit becomes impossible.

By adopting the above-described apparatus, the machining operation of the machine tool is controlled by the control unit in accordance with the machining profile data. Here, when the power failure or the drop in power supply provided to the control unit has been detected by the power-supply-drop detecting unit, the data based on the tool retreating formula is added to the machining profile data, and the tool is retreated from the workpiece under control by the control unit within a short time until the controlling operation by the control unit becomes impossible due to the drop in power supply. After the tool has been retreated, the machine tool is stopped. Accordingly, even if the uninterruptive power supply unit is not provided, it is possible to stop the tool away from the workpiece, thereby making it possible to prevent causing damage to the workpiece or the machine tool.

Further, according to a fifth aspect of the invention, there is provided a machining controlling apparatus comprising:

a control unit controlling, in accordance with machining profile data, the machining operation of a machine tool performed by synchronously driving a rotating workpiece held in a spindle apparatus and a reciprocating tool;

an input unit inputting an apparatus stop instruction for stopping the machining operation; and a tool-retreating-formula storing unit storing data based on a tool retreating formula for retreating the tool from the workpiece, wherein when the apparatus stop instruction has been inputted, the control unit decelerates the spindle apparatus and adds the data based on the tool retreating formula to the machining profile data, and stops the machine tool after the tool is retreated from the workpiece in synchronous with the rotation of the spindle apparatus based on the added machining profile data within a predetermined period until the controlling operation by the control unit becomes impossible.

By adopting the above-described apparatus, the machining operation of the machine tool is controlled by the control unit in accordance with the machining profile data. Here, when the apparatus stop instruction is inputted by the input unit, the data based on the tool retreating formula is added to the machining profile data, the tool is retreated from the workpiece within a very short time, and the machine tool is stopped after the tool has been retreated. Accordingly, even if the uninterruptive power supply unit is not provided, it is possible to stop the tool away from the workpiece at the time of, for instance, an emergency stop, thereby making it possible to prevent causing damage to the workpiece or the machine tool.

Additionally, according to a sixth aspect of the invention, in the apparatus of the fourth and fifth aspects, the data based on the tool retreating formula to be added into the machining profile data is data for accelerating or decelerating a feeding speed of the tool with respect to the workpiece within a predetermined time.

By adopting the above-described arrangement, when a power failure or a drop in power supply has been detected, or when the apparatus stop instruction has been inputted, the relative speed of the tool with respect to the workpiece gradually changes. As a result, a sudden speed change does not occur, and it is possible to prevent the occurrence of a shock entailed by the speed change, thereby making it possible to prevent causing damage to the apparatus.

DETAILED DESCRIPTION OF THE PREFERRED EMBODIMENTS

First Embodiment

Referring now to FIGS. 1 to 6, a description will be given of a machining controlling apparatus and a method of machining operation according to a first embodiment of the invention.

Figure 1:
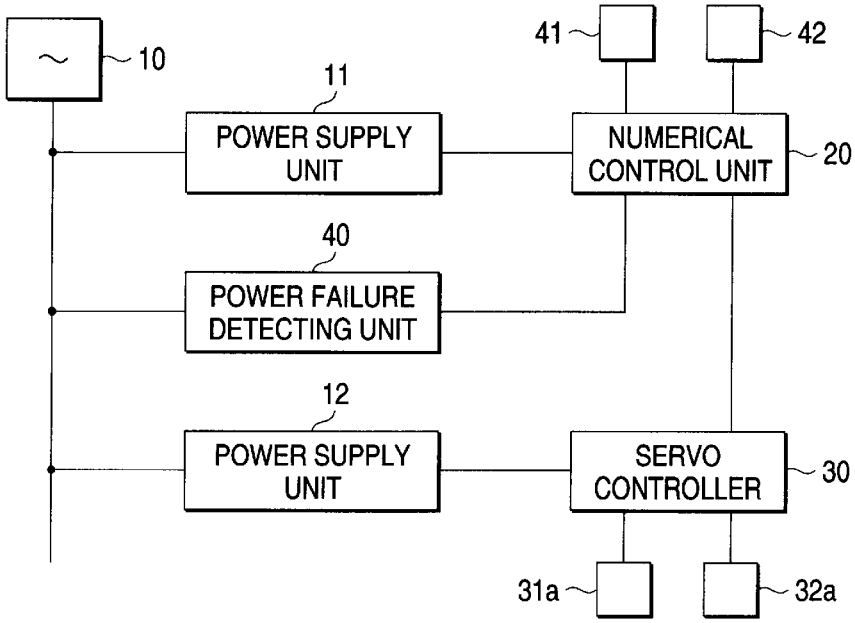
FIG. 1 is a schematic diagram of a machining controlling apparatus according to a first embodiment of the invention.

The machining controlling apparatus is designed to perform a control of a grinding machine which is a machine tool using a grinding wheel as a tool, and has power supply units 11 and 12 to which power supply is supplied from a power source 10 and which convert the power supply to a power supply for control, as shown in FIG. 1. A numerical control unit 20 serving as a control unit is connected to the power supply unit 11. The numerical control unit 20 is operated by the power supply for control converted by the power supply unit 11. A servo controller 30 is connected to the power supply unit 12, and the power supply converted by the power supply unit 12 is imparted to the servo controller 30. Connected to the servo controller 30 are motors 31*a* and 32*a*. The motor 31*a* controls the rotation of a spindle apparatus 31 for rotating a workpiece, which will be described later. The motor 32*a* controls the forward and backward movement of a wheel spindle stock 32, which will be described later. The wheel spindle stock 32 is mounted on a base 61 of the machine tool. In the grinding machine for forming a curved surface such as a cam, as the spindle apparatus 31 and the wheel spindle stock 32 are synchronously driven, the workpiece and the grinding wheel undergo relative motion to form a curved surface on the workpiece.

Figure 2:
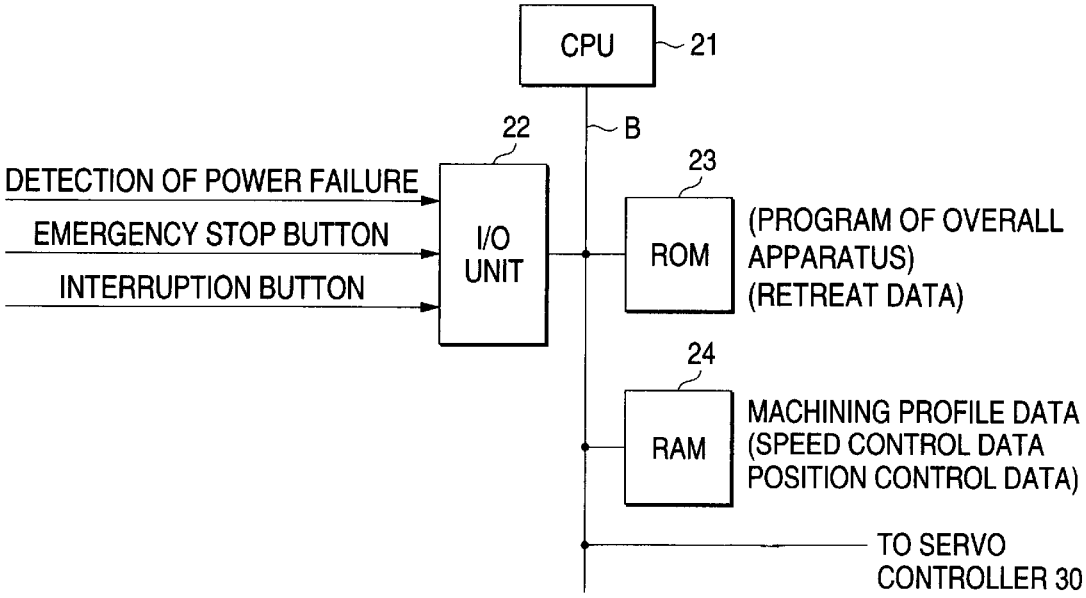
FIG. 2 is a schematic diagram illustrating a numerical control unit 20 shown in FIG. 1.

As shown in FIG. 2, the numerical control unit 20 comprises a central processing unit (CPU) 21, an input/output unit (I/O) 22, a read only memory (ROM) 23 constituting a tool-retreating-formula storing unit, and a random access memory (RAM) 24, these members being connected by buses B. Further, the bus B is connected to the servo controller 30. A program for controlling the entire numerical control unit 20 and data based on a retreating formula which will be described later are stored in the ROM 23. Machining profile data including data for controlling the speed of the spindle apparatus 31 and data for controlling the position of the wheel spindle stock 32 are stored in the RAM 24.

The machining controlling apparatus including the power supply units 11 and 12, the numerical control unit 20 and the servo controller 30, further includes a power-failure detecting unit 40 serving as a power-supply-drop detecting unit, and an emergency stop button 41 and an interruption button 42 serving as an instruction inputting unit for inputting an instruction for stopping the apparatus. The power-failure detecting unit 40, which detects a power failure, is connected to the power source 10, and transmits the result of detection to the input/output unit 22 of the numerical control unit 20. The emergency stop button 41 instructs the emergency stop of the grinding machine. The interruption button 42 instructs the interruption of grinding. The emergency stop button 41 and the interruption button 42 are connected to the input/output unit 22 of the numerical control unit 20.

Next, a description will be given of the basic operation of the grinding machine having the configuration shown in FIG. 1.

In a case where desired grinding is performed with respect to the workpiece, the CPU 21 in the numerical control unit 20 reads the speed control data for the spindle apparatus 31 and the position control data for the wheel spindle stock 32 through the RAM 24. The speed control data instructs the rotational speed of the spindle apparatus 31 for each timing to perform the grinding of the workpiece. The position control data instructs the position of the wheel spindle stock 32 on the basis of the angle of rotation of the spindle apparatus 31. The CPU 21 generates a control signal and transmits the control signal to the servo controller 30 so that the spindle apparatus 31 and the wheel spindle stock 32 are operated synchronously on the basis of the speed control data and the position control data. The servo controller 30 synchronously drives the spindle apparatus 31 and the wheel spindle stock 32 in accordance with the control signal. As a result, the grinding wheel performs a relative motion with respect to the rotating position of the workpiece, and the grinding wheel is brought into contact with the workpiece, thereby grinding the workpiece.

Figure 3:
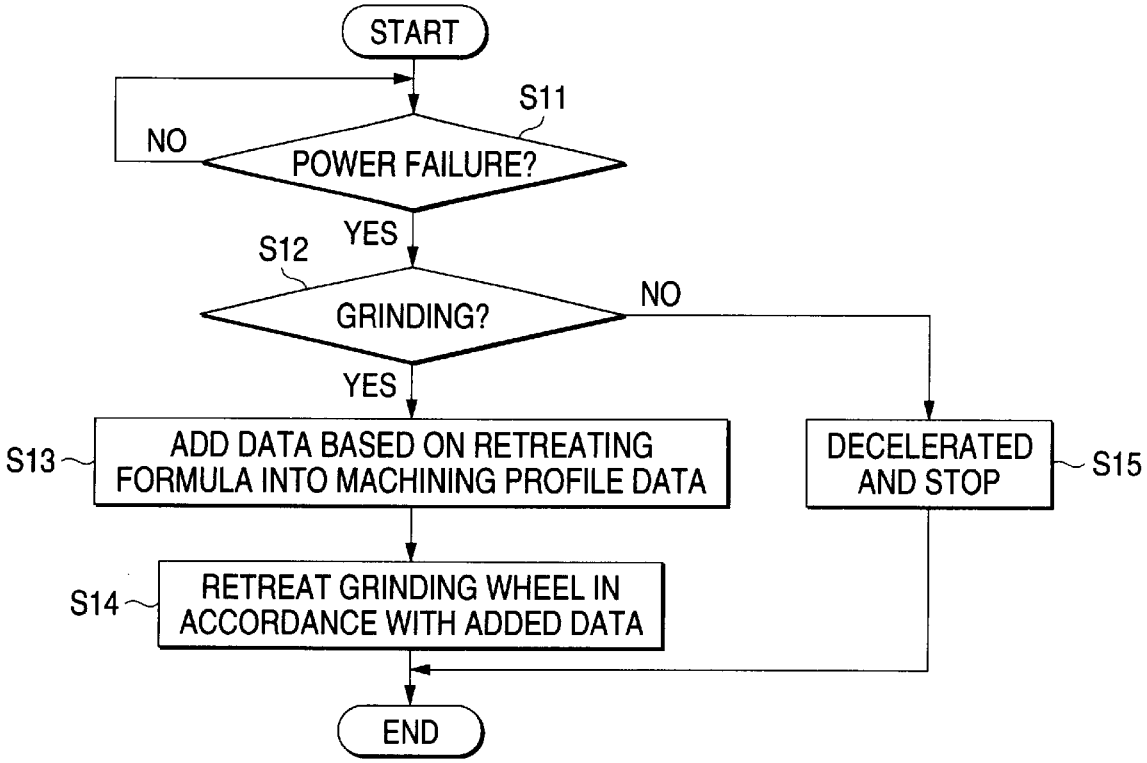
FIG. 3 is a flowchart illustrating a stopping method of a machining operation carried out by the machining controlling apparatus shown in FIG. 1.

Although described above is the operation at the time when normal grinding is performed, the machining controlling apparatus shown in FIG. 1 performs the processing of Steps S11 to S15 shown in FIG. 3 so as to stop the apparatus without imparting damage to the workpiece or the grinding machine, at the time of the power failure.

In Step S11, the power-failure detecting unit 40 monitors the voltage outputted by the power source 10, and detects whether or not a power failure has occurred. When the power source 10 outputs a normal power supply, the power-failure detecting unit 40 outputs, for example, a "high (H)" signal, and when the voltage drops due to a power failure, the power-failure detecting unit 40 outputs a "low (L)" signal. Accordingly, in the event that the power failure has occurred (YES), the "L" signal indicating that the power failure has occurred is imparted from the power-failure detecting unit 40 to the numerical control unit 20. Incidentally, the power supply units 11 and 12 have condensers with power supply capacities permitting the machining controlling apparatus to operate only for a very short period even in the case of a power failure. For this reason, a power supply which attenuates at a time constant which is determined by the power supply capacity is supplied to the numerical control unit 20. Therefore, even immediately after the occurrence of the power failure, a power supply capable of controlling the operation is imparted to the numerical control unit 20 for the duration of, for example, 150 ms in terms of the lapse of time after the occurrence of the power failure.

In Step S12, during the very short predetermined period until the controlling operation becomes impossible due to the power failure, the numerical control unit 20 determines whether or not the workpiece is being ground by the grinding wheel. If the workpiece is being ground (YES), in Step S13, data based on a retreating formula is added to the machining profile data.

Figure 4A:
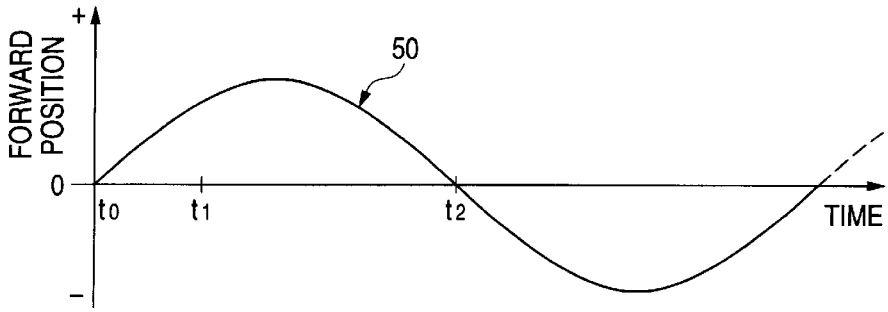
FIGS. 4A to 4D are diagrams explaining machining profile data and data based on a retreating formula.
Figure 4B:
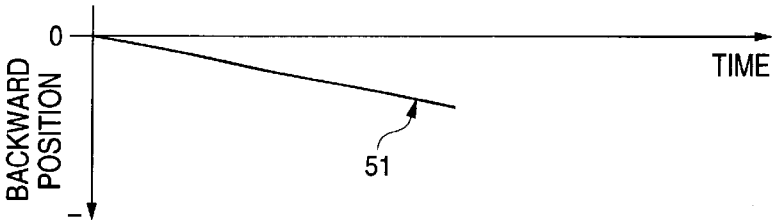

The machining profile data has a position locus 50 that the grinding wheel is moved forwardly (in the positive direction) with respect to the workpiece and is then moved backward (in the negative direction), as shown in FIG. 4A. The axis of ordinate in the graph represents the position of the grinding wheel with a center of rotation of the workpiece as an original point (0 position). In contrast, as the position data based on the retreating formula, a position locus 51 is imparted which is calculated from, for example, a linear expression and whereby the grinding wheel is moved backward substantially linearly with respect to the time, as shown in FIG. 4B.

Here, a description will be given of an example of an actual machining apparatus. A machining apparatus 60 shown in FIG. 5 performs machining of a crankshaft 70, and a movable table 62 is supported on the base 61 so as to be movable in the left-and-right direction by means of guide rails 80. A spindle stock 63 for rotatably supporting one spindle apparatus 31 is fixedly disposed on an upper surface of the movable table 62 on one side thereof, while a spindle stock 64 for rotatably supporting the other main spindle 31 is supported on the upper surface of the movable table 62 on the other side thereof so as to be movable with respect to the movable table 62 by means of guide rails 81. Chucks 65 are respectively disposed at opposing end portions of the two spindle stocks 63 and 64 through indexing devices interposed therebetween, and both end portions of the crankshaft 70 are detachably held by the chucks 65. The crankshaft 70 is formed by alternately connecting together a plurality of journals 71 and a plurality of crank pins 72 by means of crank arms 73.

A mechanism for rotating the crankshaft 70 about the journal 71 is provided in each of the spindle stocks 63 and 64, so as to rotate the selected crank pin 72 as the movable table 62 is indexed and moved with respect to the wheel spindle stock 32.

Meanwhile, the wheel spindle stock 32 is supported on an upper surface of a rear portion of the base 61 by means of guide rails 82 so as to be movable in a back-and-forth direction perpendicular to the moving direction of the movable table 62. A wheel head 67 is rotatably disposed on a side surface of the wheel spindle stock 32, and a grinding wheel 68 is attached to a distal end thereof.

Figure 6A:
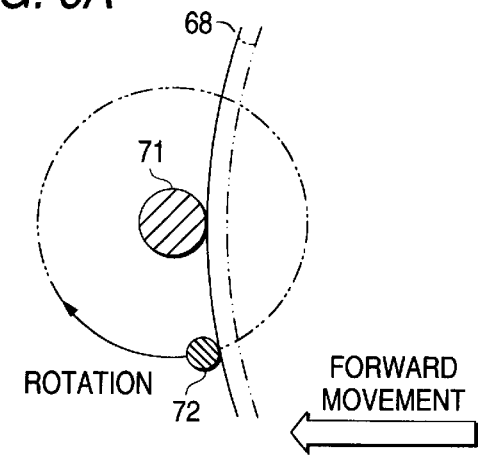
FIGS. 6A and 6B are diagrams explaining retreating operation.
Figure 6B:
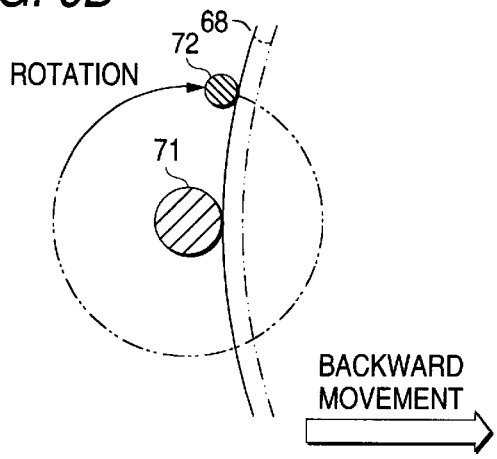

When the grinding of the selected crank pin 72 of the crankshaft 70 is performed by such a machine tool, the crank pin 72 rotates about the journal 71 in accordance with the rotation direction of the crankshaft 70, as shown in FIGS. 6A and 6B. The grinding wheel 68 moves forward or backward with respect to this crank pin 72, so as to grind the crank pin 72. Specifically, when the crank pin 72 rotates in the direction of moving away from the grinding wheel 68, the grinding wheel 68 moves forward in synchronism with the rotation (FIG. 6A), and when the crank pin 72 rotates in the direction of approaching the grinding wheel 68, the grinding wheel 68 moves backward in synchronism with the rotation (FIG. 6B), thereby grinding the crank pin 72 to a desired configuration.

Figure 4C:
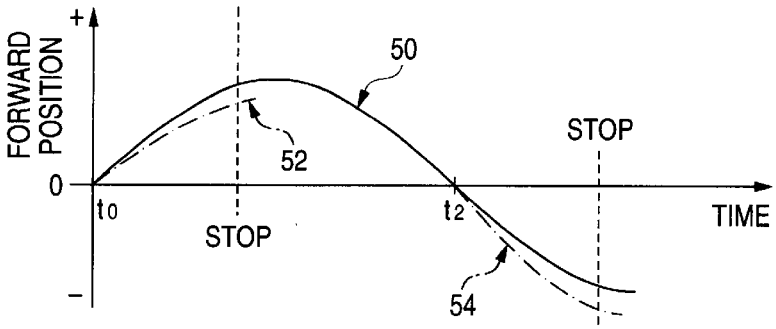
Figure 4D:
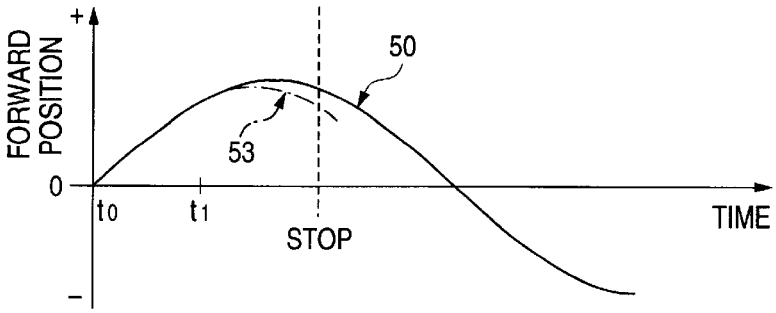
Figure 5:
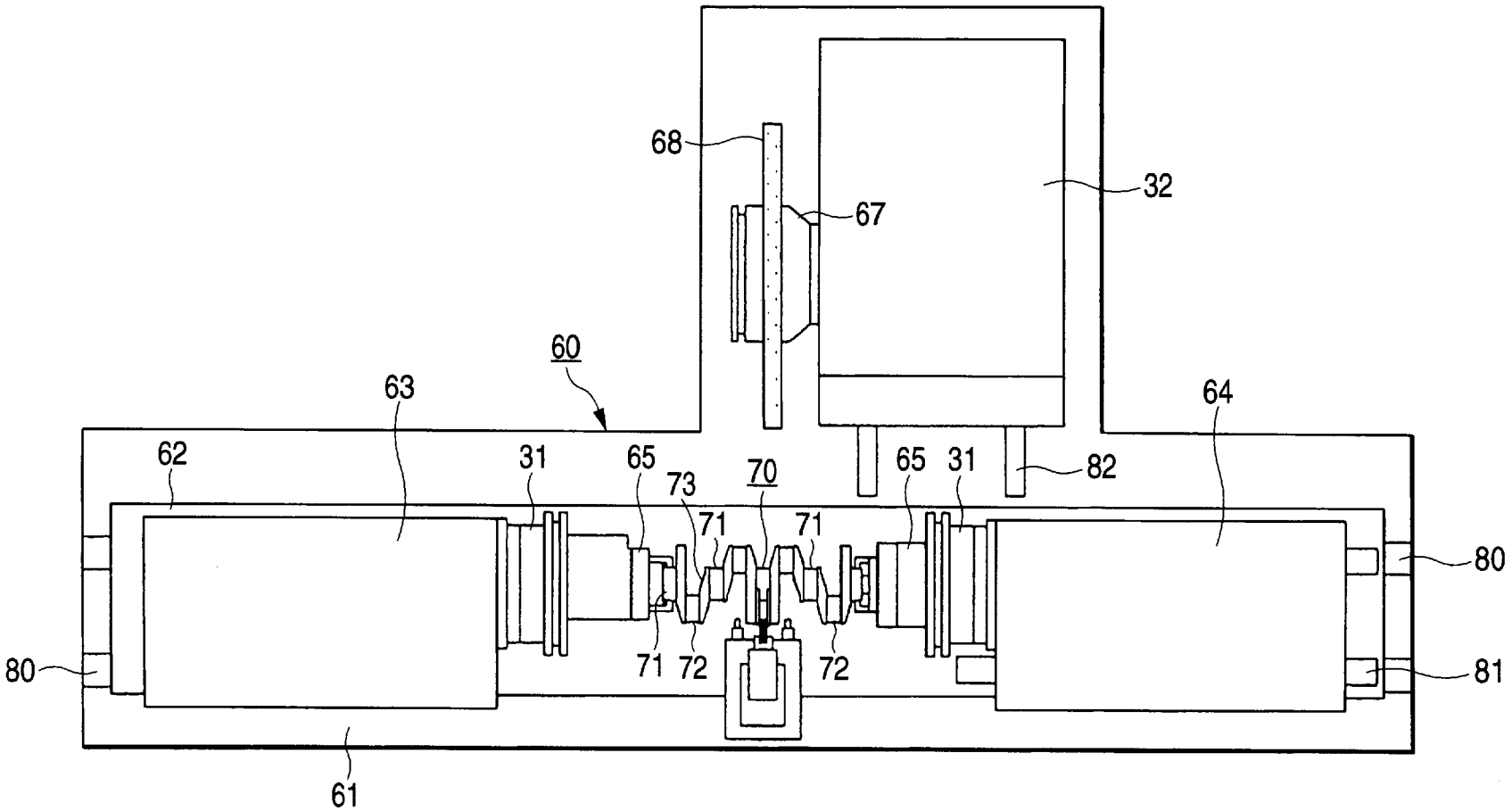
FIG. 5 is a plan view illustrating an example of a machine tool

In the event that a power failure has occurred at a timing $t_0$ when the forward movement in the machining profile data in FIG. 4A is started, the data based on the retreating formula is added to the machining profile data simultaneously with the deceleration of the spindle apparatus 31, and thus, the result of addition depicts a position locus 52 shown in FIG. 4C. In the event that a power failure has occurred at a timing $t_1$ in the machining profile data in FIG. 4A, the retreat profile data is added to the machine locus profile data simultaneously with the deceleration of the spindle apparatus 31, and thus, the result of addition depicts a position locus 53 shown in FIG. 4D. Furthermore, in the event that a power failure has occurred at a timing $t_2$ when backward movement is started, if the data based on the retreating formula is added to the machine locus profile data, and thus, the result of addition depicts a position locus 54 shown in FIG. 4C.

In the event that a power failure has occurred at a timing to when the forward movement in the machining profile data in FIG. 4A is started, the data based on the retreating formula is added to the machining profile data simultaneously with the deceleration of the spindle apparatus 31, and thus, the result of addition depicts a position locus 52 shown in FIG. 4C. In the event that a power failure has occurred at a timing $t_1$ in the machining profile data in FIG. 4A, the retreat profile data is added to the machine locus profile data simultaneously with the deceleration of the spindle apparatus 31, and thus, the result of addition depicts a position locus 53 shown in FIG. 4D. Furthermore, in the event that a power failure has occurred at a timing $t_2$ when backward movement is started, if the data based on the retreating formula is added to the machine locus profile data, the result of addition depicts a position locus 54 shown in FIG. 4C.

The CPU 21 transmits a control signal corresponding to the result of addition to the servo controller 30, and in Step S14 the servo controller 30 controls the operation of the spindle apparatus 31 and the wheel spindle stock 32 on the basis of the transmitted control signal, thereby causing the grinding wheel 68 and the workpiece to relatively retreat from each other. In addition, after the deceleration of the spindle apparatus 31 and the retreating operation of the wheel spindle stock 32, the servo controller 30 controls the motors 31*a* and 32*a* which drive the spindle apparatus 31 and the wheel spindle stock 32, and stops the motors 31*a* and 32*a* when, for example, 100 ms or thereabouts has elapsed after the occurrence of the power failure. It should be noted that the power supply stored in the condenser on the circuit and regenerative energy generated at the time of the sudden stop of the motors for driving the spindle apparatus 31 are used as the energy for allowing the wheel spindle stock 32 for moving the grinding wheel 68 to retreat from the workpiece. The rotation of the grinding wheel 68 naturally stops when the supply of power has ceased, Thus, the entire apparatus stops in a state in which the grinding wheel has retreated from the workpiece and has moved away from it about 10 mm, for instance.

On the other hand, if it is determined in Step S12 that the grinding wheel is not grinding the workpiece, the motors for driving the spindle apparatus 31 and the wheel spindle stock 32 are attenuated and stopped by subjecting them to numerical control without retreating the grinding wheel.

The above-described series of processing in Steps S11 to S15 is a processing for stopping the apparatus after retreating the grinding wheel from the workpiece immediately after the detection of the occurrence of a power failure in Step S11. However, the apparatus is stopped in a similar manner in the case of an emergency stop or an interruption of grinding as well. Namely, although in Step S11 the CPU 21 determines that a power failure has occurred when the output signal of the power-failure detecting unit 40 has changed from "H" to "L", also in a case where the button 41 or the button 42 has been pressed, the "L" signal is imparted to the CPU 21 in the same way as in Step S11. Thereafter, the processing similar to that of Steps S12 to S15 of FIG. 2 is performed, and the apparatus is stopped in the state in which the grinding wheel is retreated from the workpiece.

In this first embodiment, it is possible to obtain the following features.

The power-failure detecting unit 40 is provided for detecting a power failure while monitoring the power supply provided from the power source 10. Within a very short period until the controlling operation becomes impossible immediately after detection of the power failure, the grinding wheel is retreated from the workpiece by the numerical control unit 20 through the program in action without changing over the program to an emergency program or the like for a power failure. Thus, the apparatus can be safely stopped smoothly without causing damage to the workpiece or the apparatus even if an uninterruptive power supply unit is not provided.

Since the apparatus is constructed such that the data based on the retreating formula is added to the machining profile data of the machining program in action and the spindle apparatus 31 and the wheel spindle stock 32 are numerically controlled in correspondence with the result of addition, the grinding wheel 68 can be gradually retreated from the workpiece and can be moved away from it at an appropriate distance.

Since the buttons 41 and 42 are provided, and also in the case of an emergency stop or an interruption of grinding, the grinding wheel 68 can be smoothly retreated from the workpiece in the same way as the case in which a power failure has occurred, so that no damage is caused to the workpiece or the apparatus.

Second Embodiment

Figure 7:
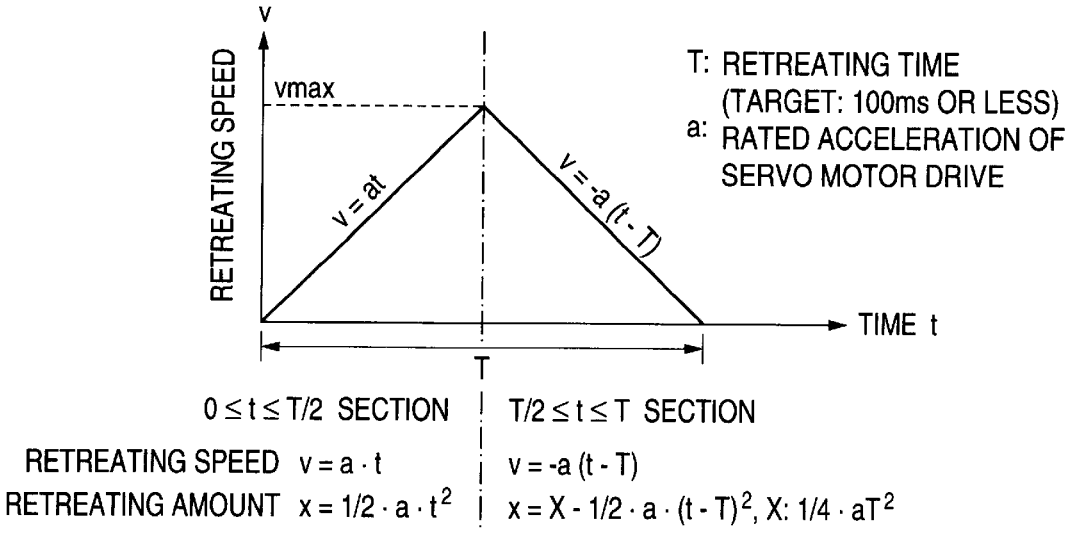
FIG. 7 is an explanatory diagram of a retreating formula according to a second embodiment of the invention.

Referring now to FIG. 7, a description will be given of a method of stopping machining operation in accordance with a second embodiment of the invention.

Figure 8:
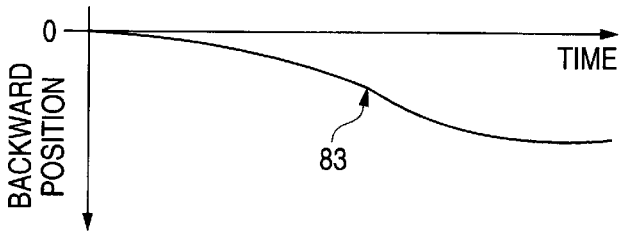
FIG. 8 is a diagram explaining data based on retreat data.

In FIG. 4B of the first embodiment, the retreat profile data is data of a position locus that the grinding wheel 68 is moved substantially linearly with the lapse of time. However, if the speed is suddenly changed at the moment when the grinding wheel 68 is moved away from the workpiece, there is a possibility that a shock is imparted to the apparatus. If, to avoid this shock, the speed with which the grinding wheel 68 is moved backward is slowed down (if the gradient of the straight line is made gentle), there are cases where sufficient retreat cannot be realized until the apparatus stops. In this embodiment, the data based on the retreating formula is set as a locus 83 which is expressed by a combination of quadratic functions, as shown in FIG. 8.

In this locus 83, if it is assumed that a predetermined retreating time is set as T (e.g., 100 ms), and that the rated acceleration of the servo motor drive is set as a, the retreating speed v from a timing 0 until a timing T/2 is set to at, while the retreating speed v from the timing T/2 until T is set to −a(t-T), as shown in FIG. 7. The amount of retreat, x, from the timing 0 until T/2 is $x=\frac{1}{2}at^2$, while the total amount of retreat, X, at the timing T/2 becomes $\frac{1}{4}at^2$. The amount of retreat, x, at the timing T/2 becomes $X-\frac{1}{2}a(t-T)^2$. This locus 83 is illustrated as position data, as shown in FIG. 8. This retreat locus 83 is added to the machine locus profile data. As a result, the relative speed for retreating the grinding wheel 68 from the workpiece is provided with acceleration with less shock.

With the data based on the retreating formula including an acceleration component, the machining controlling apparatus shown in FIG. 1 can reduce a change in speed when the grinding wheel 68 moves away from the workpiece at the time when the power failure was detected, by means of processing similar to that in Steps S11 to S15 shown in FIG. 3. Thus, the grinding wheel 68 can be subsequently moved away from the workpiece at a sufficient distance of, for example, 10 mm or thereabouts without imparting a shock to the apparatus.

Another Embodiments

It should be noted that the above-described embodiments may be modified as follows.

Although a description has been given of a grinding machine in the above-described first and second embodiments, the invention is not limited to the grinding machine. Namely, in the case of a control system of a cutting apparatus, a drilling apparatus, or the like which controls the movement of a tool on the basis of the machining profile data to perform the machining of the workpiece by synchronous motion of the tool and the workpiece, advantages similar to those of the above-described embodiments can be obtained by using the similar stopping method.

In the case of a machining controlling apparatus other than the grinding machine which performs numerical control by the numerical control unit 20, since the apparatus can be stopped after the wheel spindle stock is retreated from the workpiece during the period when effective electric power is being imparted, the uninterruptive power supply unit becomes unnecessary, and it is possible to prevent causing damage to the apparatus or the workpiece.

If a circuit or the like for detecting a drop in voltage is mounted instead of the power-failure detecting unit 40, the apparatus can be stopped before synchronous control becomes unstable upon detecting a drop in the voltage outputted by the power source 10.

While only certain embodiments have been specifically described herein, it will apparent that numerous modifications may be made thereto without departing from the spirit and scope of the invention.

What is claimed is:

1. A method of stopping a machining operation of a machine tool, wherein the machining operation of said machine tool performed by synchronously driving a rotating workpiece held by a spindle apparatus and a reciprocating tool is controlled in accordance with machining profile data stored in a controlling apparatus, said method comprising the steps of:

providing, in said controlling apparatus, a power-supply-drop detecting unit detecting at least one of a power failure and a drop in power supply supplied to said controlling apparatus and a tool-retreating-formula storing unit storing data based on a tool retreating formula for retreating said reciprocating tool from said workpiece;

decelerating said spindle apparatus and adding said data based on the tool retreating formula into said machining profile data, when the power failure or the drop in power supply is detected; and retreating said reciprocating tool from said workpiece in synchroneity with the rotation of said spindle apparatus based on said added machining profile data within a period until the controlling operation by said controlling apparatus becomes impossible, whereby said machine tool is stopped after retreating said reciprocating tool from said workpiece.

2. The method according to claim 1, wherein said data based on the tool retreating formula to be added into said machining profile data is data for at least one of accelerating and decelerating a feeding speed of said reciprocating tool with respect to said workpiece within a predetermined period.

3. The method according to claim 1, wherein said data based on the tool retreating formula to be added into said machining profile data is data expressed by a quadratic function.

4. A method of stopping a machining operation of a machine tool wherein the machining operation of said machine tool performed by synchronously driving a rotating workpiece held by a spindle apparatus and a reciprocating tool is controlled in accordance with machining profile data stored in a controlling apparatus, said method comprising the steps of:

providing, in said controlling apparatus, an input unit inputting an apparatus stop instruction for stopping the machining operation and a tool-retreating-formula storing unit storing data based on a tool retreating formula for retreating said reciprocating tool from said workpiece; decelerating said spindle apparatus and adding said data based on said tool retreating formula into said machining profile data, when the apparatus stop instruction is inputted; and retreating said reciprocating tool from said workpiece in synchroneity with the rotation of said spindle apparatus based on said added machining profile data within a period of time until the controlling operation by said controlling apparatus becomes impossible, whereby said machine tool is stopped after retreating said reciprocating tool from said workpiece.

5. The method according to claim 4, wherein said data based on the tool retreating formula to be added into said machining profile data is data for at least one of accelerating and decelerating a feeding speed of said reciprocating tool with respect to said workpiece within a predetermined time.

6. The method according to claim 4, wherein said data based on the tool retreating formula to be added into said machining profile data is data expressed by a quadratic function.

7. A machining controlling apparatus comprising:

a control unit controlling, in accordance with machining profile data, a machining operation of a machine tool performed by synchronously driving a rotating workpiece held in a spindle apparatus and a reciprocating tool;

a power-supply-drop detecting unit detecting at least one of a power failure and a drop in power supply supplied to said control unit; and a tool-retreating-formula storing unit storing data based on a tool retreating formula for retreating said reciprocating tool from said workpiece, wherein when the detected one of the power failure or the drop in power supply has been detected by said power-supply-drop detecting unit, said control unit decelerates said spindle apparatus and adds said data based on the tool retreating formula to said machining profile data, and stops said machine tool after said reciprocating tool is retreated from said workpiece in synchroneity with the rotation of said spindle apparatus based on the added machining profile data within a period until the controlling operation by said control unit becomes impossible.

8. The apparatus according to claim 7, wherein said data based on the tool retreating formula to be added into said machining profile data is data for at least one of accelerating and decelerating a feeding speed of said reciprocating tool with respect to said workpiece within a predetermined time.

9. The apparatus according to claim 7, wherein said data based on the tool retreating formula to be added into said machining profile data is data expressed by a quadratic function.

10. A machining controlling apparatus comprising:

a control unit controlling, in accordance with machining profile data a machining operation of a machine tool performed by synchronously driving a rotating workpiece held in a spindle apparatus and a reciprocating tool;

an input unit inputting an apparatus stop instruction for stopping the machining operation; and a tool-retreating-formula storing unit storing data based on a tool retreating formula for retreating said reciprocating tool from said workpiece, wherein when the apparatus stop instruction has been inputted, said control unit decelerates said spindle apparatus and adds said data based on the tool retreating formula to said machining profile data, and stops said machine tool after said reciprocating tool is retreated from said workpiece in synchroneity with the rotation of said spindle apparatus based on the added machining profile data within a predetermined period until the controlling operation by said control unit becomes impossible.

11. The apparatus according to claim 10, wherein said data based on the tool retreating formula to be added into said machining profile data is data for at least one of accelerating and decelerating a feeding speed of said reciprocating tool with respect to said workpiece within a predetermined time.

12. The apparatus according to claim 11, wherein said data based on the tool retreating formula to be added into said machining profile data is data expressed by a quadratic function.

* * * * *